US010527059B2

(12) United States Patent
Musgrave et al.

(10) Patent No.: US 10,527,059 B2
(45) Date of Patent: Jan. 7, 2020

(54) TURBOMACHINE DIFFUSER

(71) Applicant: WILLIAMS INTERNATIONAL CO., L.L.C., Walled Lake, MI (US)

(72) Inventors: Dean S. Musgrave, Dearborn, MI (US); Eric D. Reinhart, West Bloomfield, MI (US)

(73) Assignee: WILLIAMS INTERNATIONAL CO., L.L.C., Pontiac, MI (US)

( * ) Notice: Subject to any disclaimer, the term of this patent is extended or adjusted under 35 U.S.C. 154(b) by 708 days.

(21) Appl. No.: 15/030,252

(22) PCT Filed: Oct. 21, 2014

(86) PCT No.: PCT/US2014/061613

§ 371 (c)(1),
(2) Date: Apr. 18, 2016

(87) PCT Pub. No.: WO2015/061344

PCT Pub. Date: Apr. 30, 2015

(65) Prior Publication Data

US 2016/0281734 A1 Sep. 29, 2016

Related U.S. Application Data

(60) Provisional application No. 61/893,518, filed on Oct. 21, 2013.

(51) Int. Cl.
*F04D 29/44* (2006.01)
*F04D 17/10* (2006.01)

(52) U.S. Cl.
CPC ..... *F04D 29/441* (2013.01); *F04D 17/10* (2013.01)

(58) Field of Classification Search
CPC ..... F04D 17/10; F04D 25/024; F04D 29/441; F04D 29/444
See application file for complete search history.

(56) References Cited

U.S. PATENT DOCUMENTS 786,384 A 4/1905 Richards
1,879,561 A 9/1932 Smith
(Continued)

FOREIGN PATENT DOCUMENTS

CN 100374733 C 3/2008
DE 971229 A 12/1958
(Continued)

OTHER PUBLICATIONS

Non-Final Office Action in Counterpart Chinese Applicatoin No. 201480057740.7, English Translation + original Chinese language document, Apr. 21, 2017, 13 pages.
(Continued)

*Primary Examiner* — Jason D Shanske
*Assistant Examiner* — Aye S Htay
(74) *Attorney, Agent, or Firm* — Raggio & Dinnin, P.C.; Kurt L. VanVoorhies

(57) ABSTRACT

A diffuser (10) comprises first (10.1) and second (10.2) annular portions bounded by forward (32) and aft (26) annular walls, wherein the first annular portion (10.1) is vaneless and radially within the second annular portion (10.2), and the second annular portion (10.2) is radially relatively compact and incorporates a plurality of vanes (48) with relatively high solidity, wherein the forward (32) or/and aft (26) annular walls is/are sloped so as to provide for meridional divergence within the second annular portion (10.2) of the diffuser (10), and the vanes (48) are shaped so as to substantially conform to the flow field within the second annular portion (10.2).

26 Claims, 11 Drawing Sheets

(56) References Cited

U.S. PATENT DOCUMENTS

| | | | | |
|---|---|---|---|---|
| 2,283,176 | A | 5/1942 | Birmann | |
| 2,372,880 | A | 4/1945 | Browne | |
| 2,681,760 | A | 6/1954 | Lundquist | |
| 2,709,893 | A | 6/1955 | Birmann | |
| 2,715,814 | A | 8/1955 | Barr et al. | |
| 2,819,837 | A | 1/1958 | Loeb | |
| 2,836,347 | A | 5/1958 | Barr et al. | |
| 2,898,031 | A | 8/1959 | Voigt | |
| 2,945,349 | A | 7/1960 | Ritzi | |
| 2,967,013 | A | 1/1961 | Dallenbach et al. | |
| 3,132,594 | A | 5/1964 | Shiley et al. | |
| 3,150,823 | A | 9/1964 | Adams | |
| 3,369,737 | A | 2/1968 | Switzer et al. | |
| 3,460,748 | A | 8/1969 | Erwin | |
| 3,658,437 | A | 4/1972 | Soo | |
| 3,771,925 | A | 11/1973 | Friberg et al. | |
| 3,860,360 | A * | 1/1975 | Yu | F04D 29/441 415/208.3 |
| 3,861,826 | A | 1/1975 | Dean, Jr. | |
| 3,868,196 | A | 2/1975 | Lown | |
| 3,873,232 | A | 3/1975 | Stein et al. | |
| 3,904,308 | A | 9/1975 | Ribaud | |
| 3,904,312 | A | 9/1975 | Exley | |
| 3,936,223 | A | 2/1976 | Baghdadi | |
| 3,997,281 | A * | 12/1976 | Atkinson | F04D 29/444 415/207 |
| 4,012,166 | A | 3/1977 | Kaesser et al. | |
| 4,099,891 | A | 7/1978 | Campell | |
| 4,164,845 | A | 8/1979 | Exley et al. | |
| 4,181,467 | A | 1/1980 | Campbell | |
| 4,302,150 | A | 11/1981 | Wieland | |
| 4,428,715 | A | 1/1984 | Wiggins | |
| 4,431,374 | A | 2/1984 | Benstein et al. | |
| 4,737,071 | A | 4/1988 | Horn, Jr. | |
| 4,752,182 | A | 6/1988 | Zaehring et al. | |
| 4,790,720 | A | 12/1988 | Rodgers | |
| 5,145,317 | A | 9/1992 | Brasz | |
| 5,178,516 | A * | 1/1993 | Nakagawa | F04D 29/444 415/208.3 |
| 5,368,440 | A | 11/1994 | Japikse et al. | |
| 5,529,457 | A * | 6/1996 | Terasaki | F04D 29/444 415/208.3 |
| 5,857,834 | A * | 1/1999 | Nagaoka | F04D 29/2216 415/199.1 |
| 5,927,939 | A | 7/1999 | Harada et al. | |
| 5,971,705 | A | 10/1999 | Nagaoka et al. | |
| 6,139,266 | A | 10/2000 | Nagaoka et al. | |
| 6,168,375 | B1 * | 1/2001 | LaRue | F04D 25/04 415/146 |
| 6,200,094 | B1 | 3/2001 | Skoch et al. | |
| 6,203,275 | B1 | 3/2001 | Kobayashi et al. | |
| 6,290,460 | B1 | 9/2001 | Nagaoka et al. | |
| 6,312,222 | B1 | 11/2001 | Nagaoka et al. | |
| 6,364,607 | B2 | 4/2002 | Nagaoka et al. | |
| 6,371,724 | B2 | 4/2002 | Nagaoka et al. | |
| 7,146,813 | B2 | 12/2006 | Brasz et al. | |
| 7,326,027 | B1 | 2/2008 | Skoch et al. | |
| 7,581,925 | B2 | 9/2009 | Xu et al. | |
| 7,845,900 | B2 | 12/2010 | Roduner et al. | |
| 8,016,557 | B2 | 9/2011 | Abdelwahab et al. | |
| 8,162,604 | B2 | 4/2012 | Kühnel et al. | |
| 8,511,981 | B2 | 8/2013 | Small et al. | |
| 8,596,968 | B2 | 12/2013 | Emmerson | |
| 8,602,728 | B2 | 12/2013 | Swiatek et al. | |
| 8,616,836 | B2 | 12/2013 | Blair et al. | |
| 2008/0170938 | A1 | 7/2008 | Shinohara | |
| 2008/0276613 | A1 | 11/2008 | Noelle et al. | |
| 2010/0129204 | A1 | 5/2010 | Higashimori et al. | |
| 2010/0150701 | A1 | 6/2010 | Simon et al. | |
| 2010/0166552 | A1 | 7/2010 | Emmerson | |
| 2010/0215489 | A1 | 8/2010 | Johnson | |
| 2011/0194931 | A1 * | 8/2011 | Swiatek | F04D 29/444 415/206 |
| 2012/0121402 | A1 | 5/2012 | Brown et al. | |
| 2013/0315741 | A1 | 11/2013 | Small et al. | |
| 2014/0064953 | A1 | 3/2014 | Swiatek et al. | |
| 2014/0186173 | A1 | 7/2014 | Blair et al. | |
| 2014/0271170 | A1 | 9/2014 | Holbrook | |

FOREIGN PATENT DOCUMENTS

| | | | |
|---|---|---|---|
| DE | 19502808 | C2 | 2/1997 |
| EP | 138480 | A2 | 4/1985 |
| EP | 795688 | B1 | 3/2003 |
| EP | 1199478 | B1 | 9/2004 |
| EP | 2650546 | A1 | 10/2013 |
| GB | 170815 | A | 10/1921 |
| GB | 271074 | A | 10/1927 |
| GB | 305214 | A | 10/1929 |
| GB | 604121 | A | 6/1948 |
| GB | 669357 | A | 4/1952 |
| GB | 701503 | A | 12/1953 |
| GB | 701560 | A | 12/1953 |
| GB | 701561 | A | 12/1953 |
| GB | 710362 | A | 6/1954 |
| GB | 722677 | A | 1/1955 |
| GB | 753231 | A | 7/1956 |
| GB | 783448 | A | 9/1957 |
| GB | 790873 | A | 2/1958 |
| GB | 792122 | A | 3/1958 |
| GB | 864645 | A | 4/1961 |
| GB | 2013280 | A | 8/1979 |
| GB | 2041149 | A | 9/1980 |
| JP | 57126600 | A | 8/1982 |
| JP | 9177698 | A | 7/1997 |
| JP | 2012072735 | A | 4/2012 |
| JP | 2013124624 | A | 6/2013 |
| RU | 2353818 | C1 | 4/2009 |
| SU | 945499 | A1 | 7/1982 |
| WO | 9961801 | A1 | 12/1999 |
| WO | 2009042326 | A1 | 4/2009 |
| WO | 2012019650 | A1 | 2/2012 |

OTHER PUBLICATIONS

Mohtar, H.; Chesse, P., Chalet, D., Hetet, J.-F; and Yammine, A.; "Effect of Diffuser and Volute on Turbocharger Centrifugal Compressor Stability and Performance: Experimental Study", Oil & Gas Science and Technology—Rev. IFP Energies nouvelles, vol. 66 (2011), No. 5, pp. 779-790.

Xu, Cheng and Amano, Ryoichi S., "Empirical Design Considerations for Industrial Centrifugal Compressors", International Journal of Rotating Machinery, vol. 2012, Article ID 184061, 15 pp.

International Search Report in International Application No. PCT/US2014/061613, dated Jan. 12, 2015, 4 pages.

Written Opinion of the International Searching Authority in International Application No. PCT/US2014/061613, dated Jan. 12, 2015, 7 pages.

International Preliminary Report on Patentability of the International Preliminary Examining Authority in International Application No. PCT/US2014/061613, dated Sep. 15, 2015, 37 pages.

Boyce, Meherwan P., "Principles of Operation and Performance Estimation of Centrifugal Compressors", Proceedings of the Twenty-Second Turbomachinery Symposium, Tutorials, Texas A&M University Turbomachinery Laboratory, pp. 161-177.

Smith, Pieter E. S., "Theoretical Design of a Centrigugal Compressor for Use in a Miniature Gas Turbine", Sep. 12, 1997, Internet document downloaded on Jul. 19, 2013, 14 pp.

Håll, Ulf, "Radial Compressor", Lecture Notes to CRS, Gas Turbine Theory, Chapter 4, Centrifugal Compressors, Apr. 11, 2002, Internet document downloaded from http://www.tfd.chalmers.se/~ulfh/gas_turb_h/crsohbilder/crs4en.pdf on Jul. 19, 2013, 7 pp.

Tatar, Ozturk; Ozturk, Adnan; and Pinarbasi, Ali; "Flow analysis in centrifugal compressor vaneless diffusers", Journal of Scientific & Industrial Research, vol. 67, May 2008, pp. 348-354.

Miwa, Jyunichi; Dou, Chun Hui; Sawai, Kazuki; Namura, Moriaki; and Toriyama, Toshiyki, "Aerodynamic Consideration on Impeller, Diffuser and Volute for MEMS Centrifugal Compressor", PowerMEMS 2009, Washington DC, USA, Dec. 1-4 2009, pp. 570-573.

(56) References Cited

OTHER PUBLICATIONS

Ganesh, Ch. Sivaji; Nagpurwala, Q. H.; Dixit, C.S. Bhaskar; "Effect of Leading Edge Sweep on the Performance of a Centrifugal Compressor Impeller", Sastech Journal, vol. 9, Issue 2, Sep. 2010, pp. 55-62.

European Patent Office Communication Under Rule 71(3) EPC in counterpart European Patent Application No. 14792705.7, dated Apr. 8, 2019, 40 pp.

* cited by examiner

TURBOMACHINE DIFFUSER

CROSS-REFERENCE TO RELATED APPLICATIONS

The instant application claims the benefit of prior U.S. Provisional Application Ser. No. 61/893,518 filed on 21 Oct. 2013, which is incorporated herein by reference.

BRIEF DESCRIPTION OF THE DRAWINGS

In the accompanying drawings:

FIG. 11*c* illustrates an end view of the vane.

DESCRIPTION OF EMBODIMENT(S)

Figure 1:
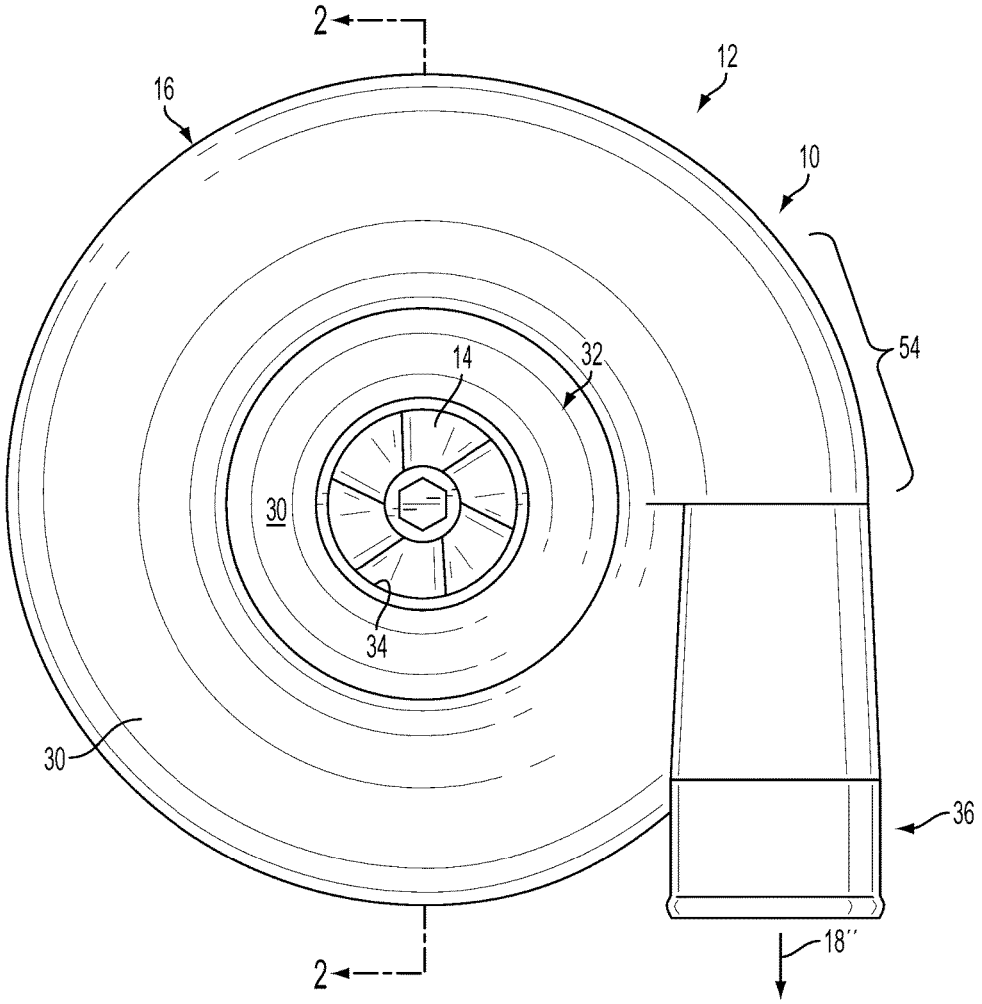
FIG. 1 illustrates an aft plan view of a radial compressor that internally incorporates a diffuser.
Figure 2:
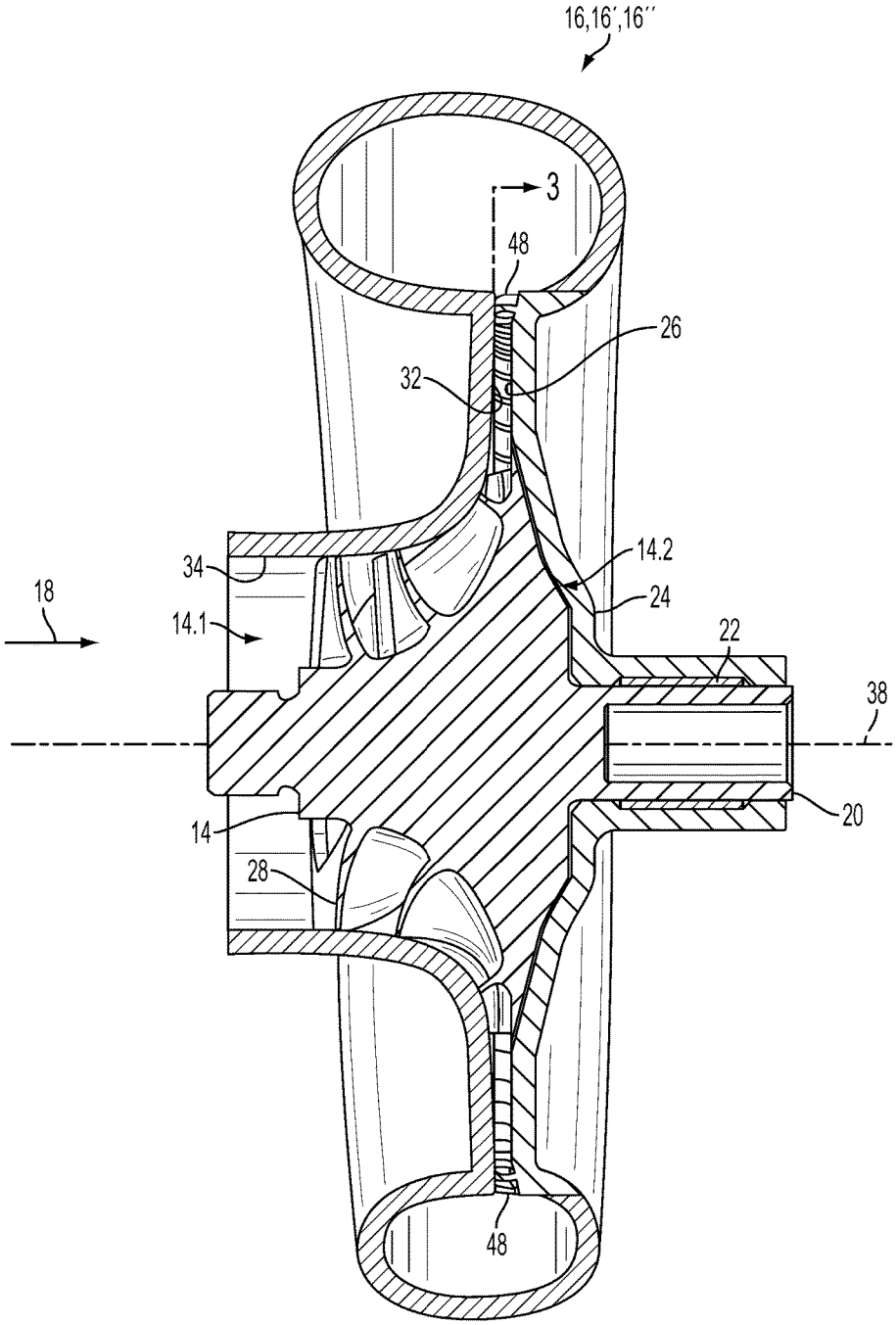
FIG. 2 illustrates a radial cross-section of the radial compressor illustrated in FIG. 1.
Figure 3:
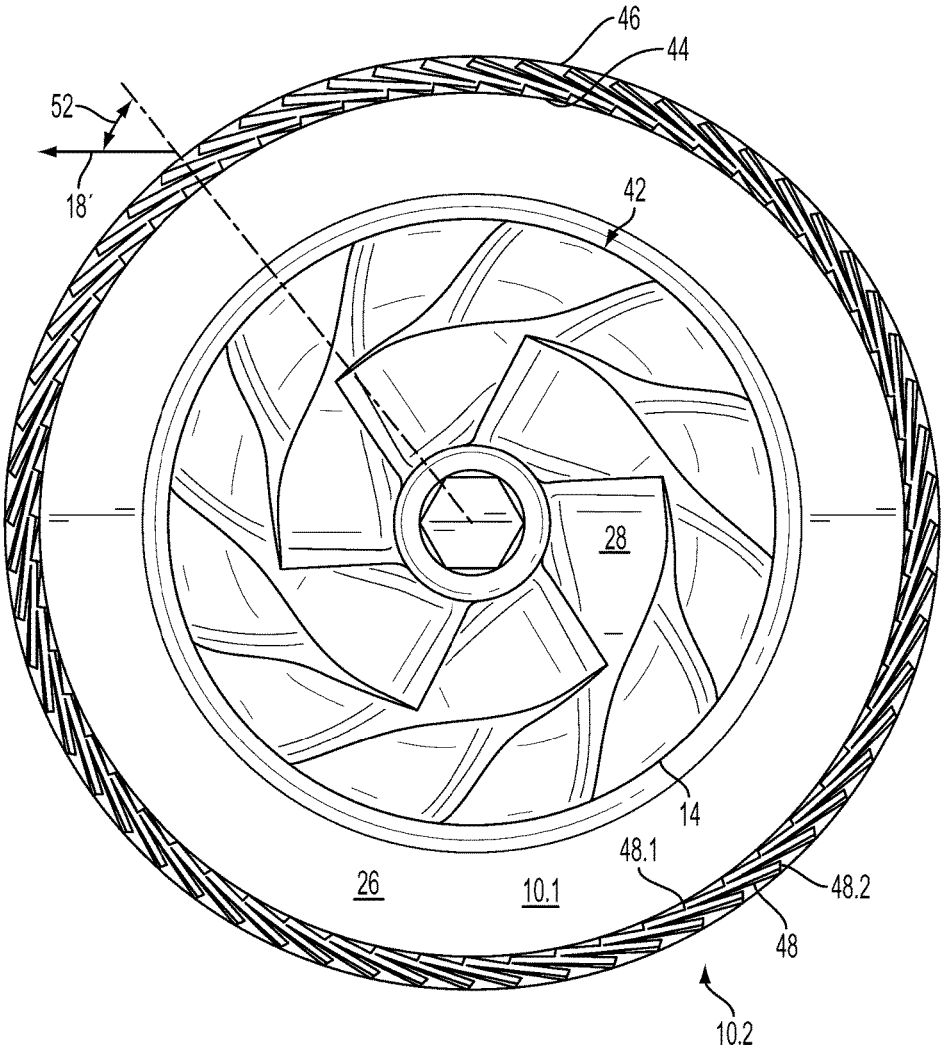
FIG. 3 illustrates aft plan view of a radial compressor illustrated in FIG. 1, but absent the forward housing portion thereof.
Figure 4:
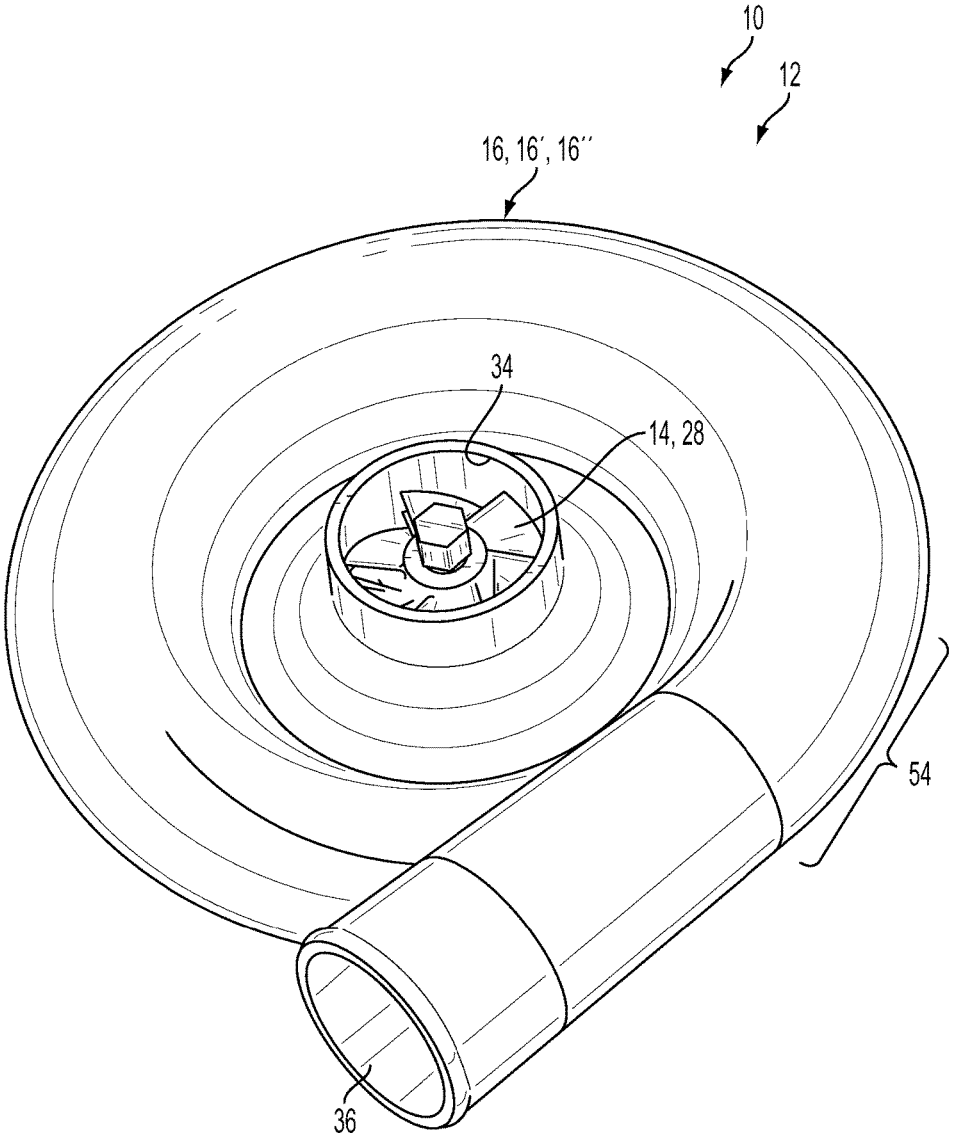
FIG. 4 illustrates an isometric view of the radial compressor illustrated in FIG. 1.
Figure 5:
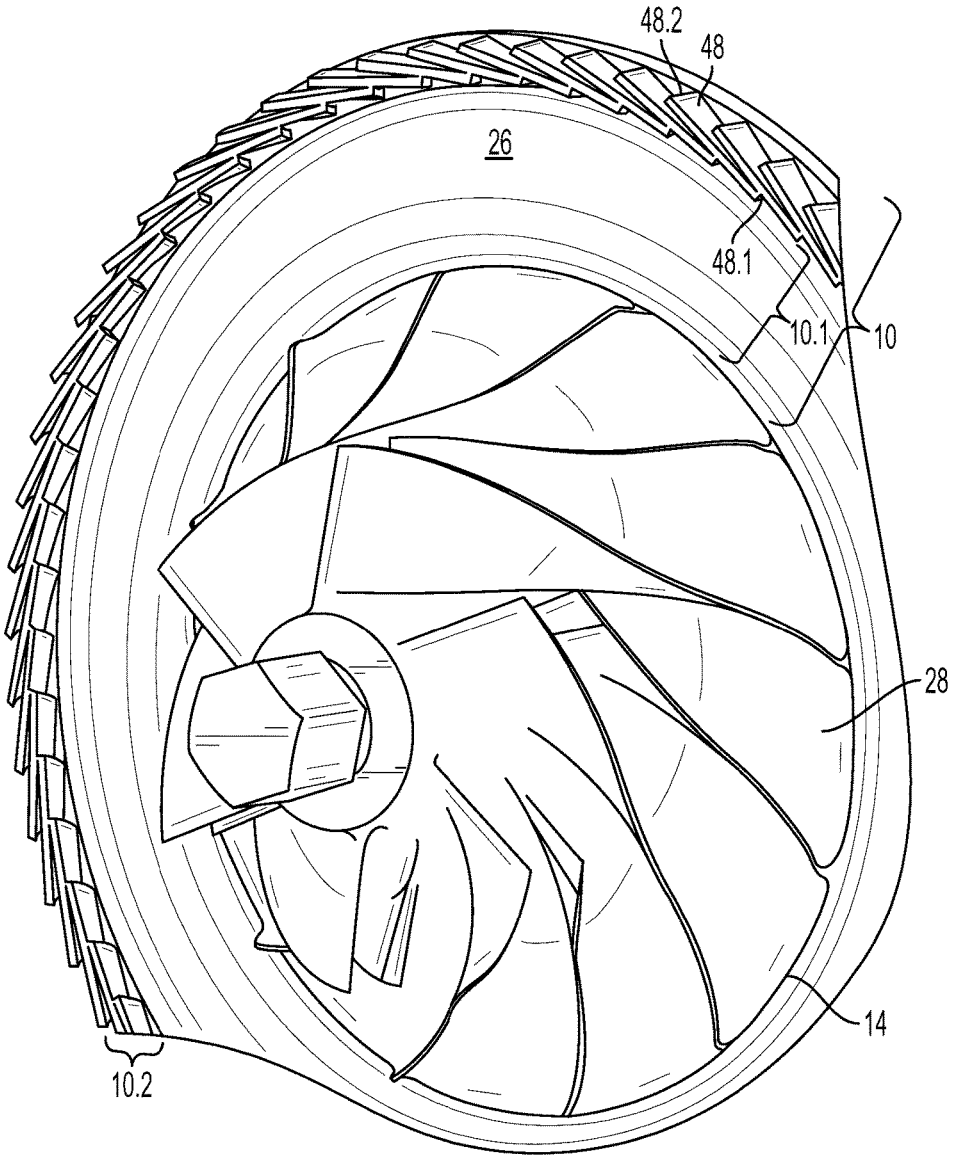
FIG. 5 illustrates a fragmentary isometric view of the portion of the radial compressor illustrated in FIG. 3.
Figure 6:
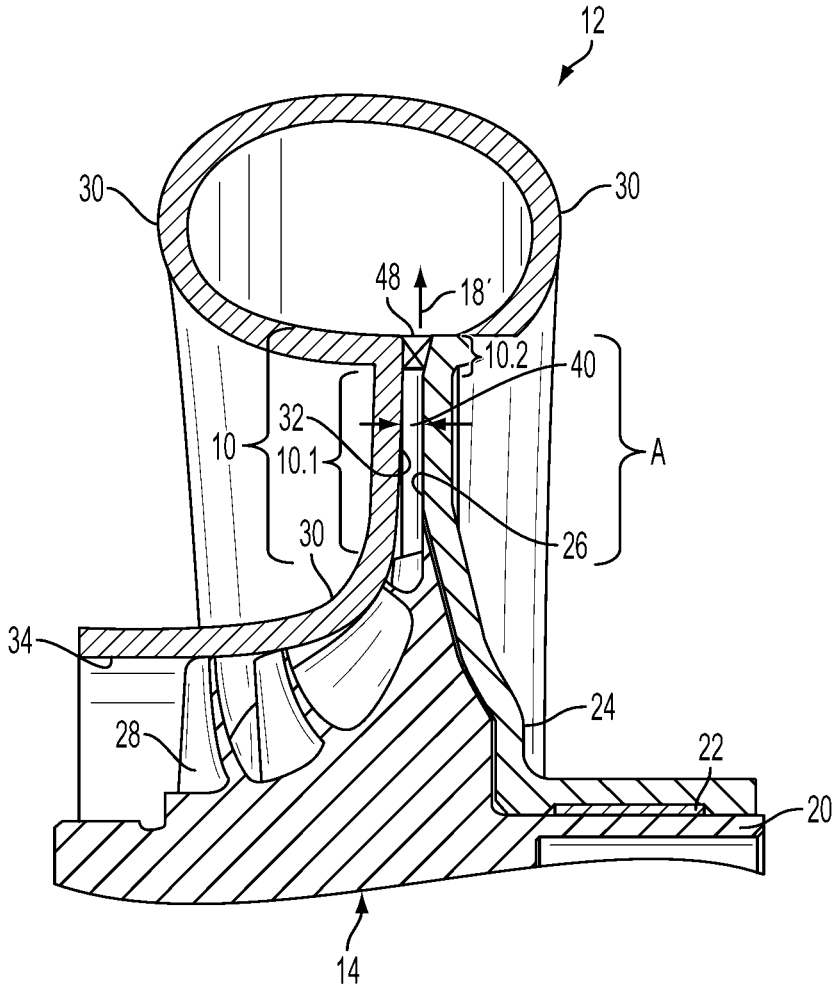
FIG. 6 illustrates a fragmentary radial cross-section of the radial compressor illustrated in FIG. 1, but illustrating only a single vane of the diffuser.
Figure 7:
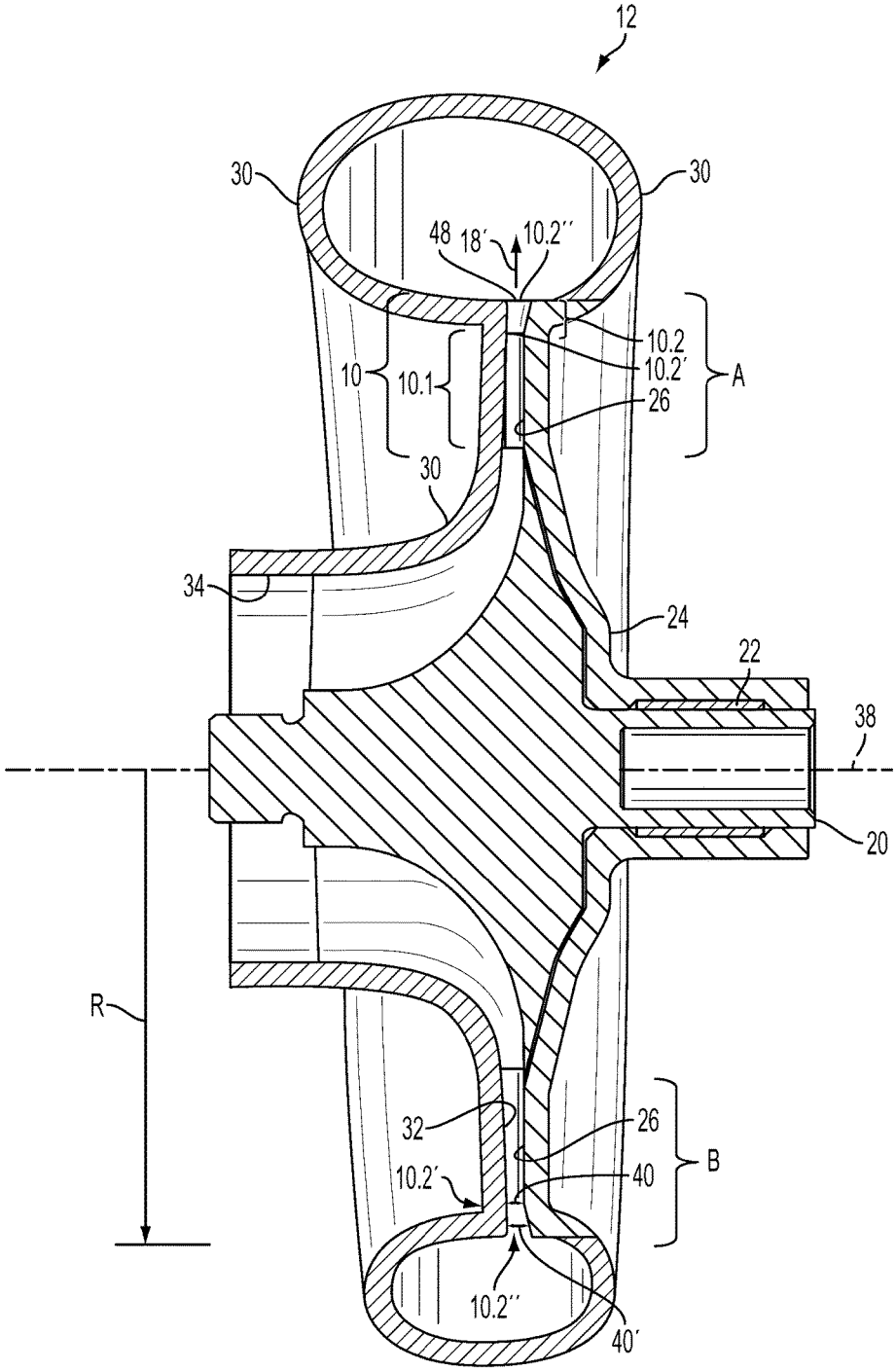
FIG. 7 illustrates a radial cross-section of the radial compressor illustrated in FIG. 1, but without the detailed structure of the blades of the impeller or the plurality of vanes of the diffuser, so as to more clearly illustrate the meridional shape of the flow passage through the impeller and diffuser.

Referring to FIGS. 1-7, a diffuser 10 incorporated in a radial compressor 12,—for example, of either a turbocharger or supercharger,—is operative between the impeller 14 and the collector 16 of the radial compressor 12, so as to provide for reducing the velocity of the gases 18 compressed by and exiting the impeller 14, prior to entering the collector 16, so as to provide for improving the operating efficiency of the radial compressor 12. The impeller 14 incorporates a stub shaft portion 20 that is supported by a bearing 22 from an associated centerbody 24, that later of which also constitutes an aft annular wall 26 of the radial compressor 12 that abuts an aft side 14.2 of the impeller 14 that is free of any blades. Notwithstanding that the centerbody 24 is illustrated in FIGS. 2, 6 and 7 as a dedicated portion of the radial compressor 12, alternatively, the centerbody 24 may be extended aftward to provide for completely supporting an associated rotor shaft that is also operatively coupled to other elements, for example either a turbine of a turbocharge or a drive of a supercharger. The forward side 14.1 of the impeller 14 incorporates a plurality of blades 28 that provide for pumping/compressing the gases 18, in cooperation with a housing portion 30 of the radial compressor 12, a portion of which constitutes an annular forward annular wall 32 that abuts the forward side 14.1 of the impeller 14 and that surrounds an axially-oriented central inlet duct 34 through which the gases 18 is drawn into the radial compressor 12. A portion of the housing portion 30 comprises the collector 16 of the radial compressor 12 that radially abuts the annular forward annular wall 32. For example, the collector 16 comprises a plenum 16'—for example, that is configured as a volute 16" that provides for receiving compressed gases 18' from the diffuser 10 and then redirecting and discharging the compressed gases 18' through an outlet duct 36. The impeller 14 is adapted to rotate about a central axis 38 oriented transversely relative to the forward 32 and aft 26 annular walls, the forward annular wall 32 is adjacent to the forward side 14.1 of the impeller 14 that provides for receiving gases 18 to be compressed, the aft annular wall 26 is separated from the forward annular wall 32 by a gap 40, and the impeller 14 is located between the forward 32 and aft 26 annular walls within a portion of the gap 40.

The diffuser 10 is located between the forward 32 and aft 26 annular walls and comprises first 10.1 and second 10.2 annular portions, the former of which is upstream of the latter. The first annular portion 10.1 is concentric with, radially adjacent to, and around, a circumferential discharge boundary 42 of the impeller 14. The second annular portion 10.2 is concentric with, radial adjacent to, and around, a radially outer boundary 44 of the first annular portion 10.1, and a radially outer boundary 46 of the second annular portion 10.2 is concentric with, radial adjacent to, and within the collector 16. Accordingly, compressed gases 18' from the impeller 14 are first discharged therefrom into the first annular portion 10.1, and after flowing therethough, then flow through the second annular portion 10.2, after which the resulting diffused compressed gases 18" are discharged therefrom into the collector 16.

The first annular portion 10.1 of the diffuser 10 is vaneless and the second annular portion 10.2 incorporates a plurality of vanes 48, wherein the vaneless first annular portion 10.1 provides for reducing the velocity of the compressed gases 18' prior to entering the vaned second annular portion 10.2. For example, the radius ratio of the first annular portion 10.1—i.e. the ratio of the radius of the radially outer boundary 44 of the first annular portion 10.1 to the outer radius of the impeller 14—is sufficiently great that the mean velocity of compressed gases 18' is reduced within the first annular portion 10.1 to Mach 0.7 or less upon entering the second annular portion 10.2. Upon exiting the second annular portion 10.2, the mean velocity of the compressed gases 18' is reduced to a sufficiently low velocity, for example, less than Mach 0.5, so that the compressed gases 18' substantially act as an incompressible fluid. For example, in one embodiment, the mean velocity of the compressed gases 18' is reduced to about Mach 0.45 upon exiting the second annular portion 10.2 of the diffuser 10.

At least one of the forward 32 or aft 26 annular walls abutting the second annular portion 10.2 of the diffuser 10 is sloped so that the axial gap 40' between the forward 32 and aft 26 annular walls increases with respect to radial distance R from the central axis 38, so as to provide for a meridional divergence of the diffuser 10 within the second annular portion 10.2 thereof, for example, in a range of 1.4 to 2.0, wherein meridional divergence is defined as the ratio of the axial gap 40' at the exit 10.2" of the second annular portion 10.2 to the axial gap 40' at the entrance 10.2' of the second annular portion 10.2. The axial extent of the vanes 48 within the second annular portion 10.2 also varies with respect to radial distance R from the central axis 38, so as to substantially conform to the axial gap 40', wherein the vanes 48 provide for substantially preventing wall separation of the compressed gases 18' flowing therethrough, so that the associated flow of compressed gases 18' remains attached to the forward 32 and aft 26 annular walls while flowing through the meridionally divergent second annular portion 10.2, so that the meridional divergence provides for further diffusing the compressed gases 18' flowing therethrough. Referring to FIGS. 6 and 7, the portion designated as "A" illustrates a single vane 48 of the diffuser 10, so as to more clearly illustrate the meridional profile of the diffuser 10, including the merdional divergence of the second annular portion 10.2 thereof, wherein the second annular portion 10.2 is indicated with a single cross-hatch ('X'). Referring to FIG. 7, the structure of the blades 28 of the impeller 14 is not shown, and vanes 48 of the diffuser are not shown in the portion designated as "B", so as to more clearly illustrate the meridional profile of the entire radial compressor 12.

Each of the plurality of vanes 48 of the second annular portion 10.2 of the diffuser 10 is oriented to as to substantially conform to what would be the corresponding direction of the flow field within the second annular portion 10.2 but with the vanes 48 absent. As a result, for each vane 48 of the plurality of vanes 48, an angle of a tangent to a surface of the vane 48 varies with axial position along the vane 48, and the angle of the tangent to the surface of the vane 48 varies with radial position along the vane 48. More particularly, in one set of embodiments, each vane 48 of the plurality of vanes 48 is shaped so a variation of the angle of the tangent of the surface of the vane 48 with respect to axial position along the vane 48 and with respect to radial position along the vane 48 substantially corresponds to simulated directions of flow within regions of the second annular portion 10.2 adjacent to the vane 48 for at least one operating condition when the impeller 14 cooperates with the diffuser 10. Accordingly, each vane 48 is twisted along a length thereof so that the angle of the vane 48 relative to a longitudinal axis thereof varies with position along the vane 48, with the leading-edge (LE) angle of each vane 48 substantially matched to the measured or analytically-or-computationally predicted flow discharge conditions at the exit of the first annular portion 10.1, and with the exit angle of each vane 48 substantially matched to the inlet flow conditions of the collector 16. For example, in one set of embodiments, the shape of the vane 48 is configured to optimize the inlet conditions of the collector 16, for example, so as to safely maximize the loading of the vanes 48 and provide for relatively uniform exit conditions, with the collector 16 similarly designed to match the exit conditions of the vaned second annular portion 10.2 of the diffuser 10.

Figure 8:
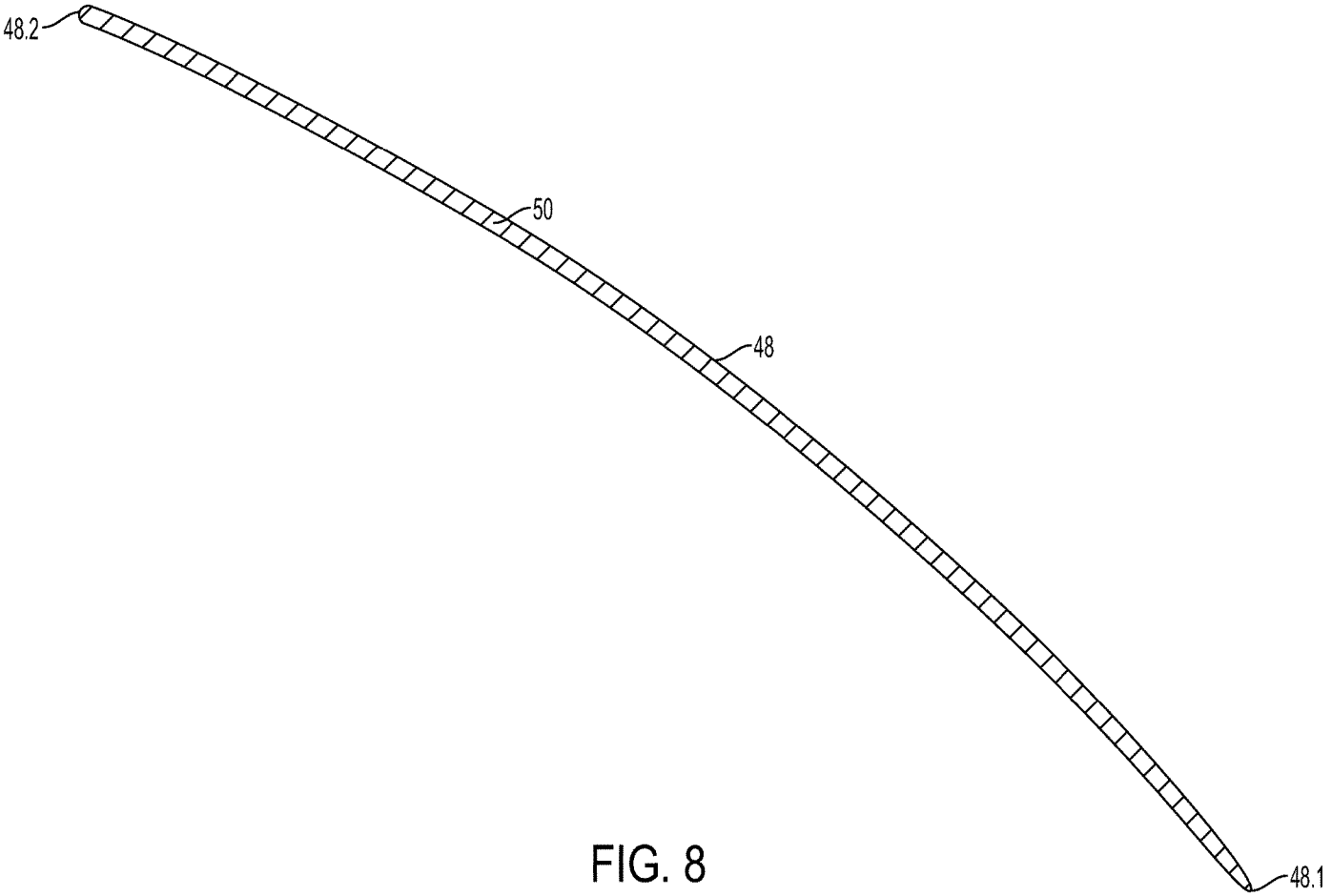
FIG. 8 illustrates a longitudinal cross section of a vane incorporating an aerodynamic profile.

The second annular portion 10.2 is relatively compact, and the plurality of vanes 48 therein are of relatively high solidity. For example, the second annular portion 10.2 is configured with a radius ratio in the range of 1.08 to 1.20, and the solidity of the plurality of vanes 48 is generally within a range of 1.8 to 4.0, and, in one set of embodiments, within the range of 3.0 to 3.5, wherein solidity is defined as the ratio of the choral length of each vane 48 to the mean circumferential spacing between the vanes 48. Referring to FIG. 8, in one set of embodiments, each vane 48 incorporate an airfoil-shaped cross-sectional profile 50.

Figure 9:
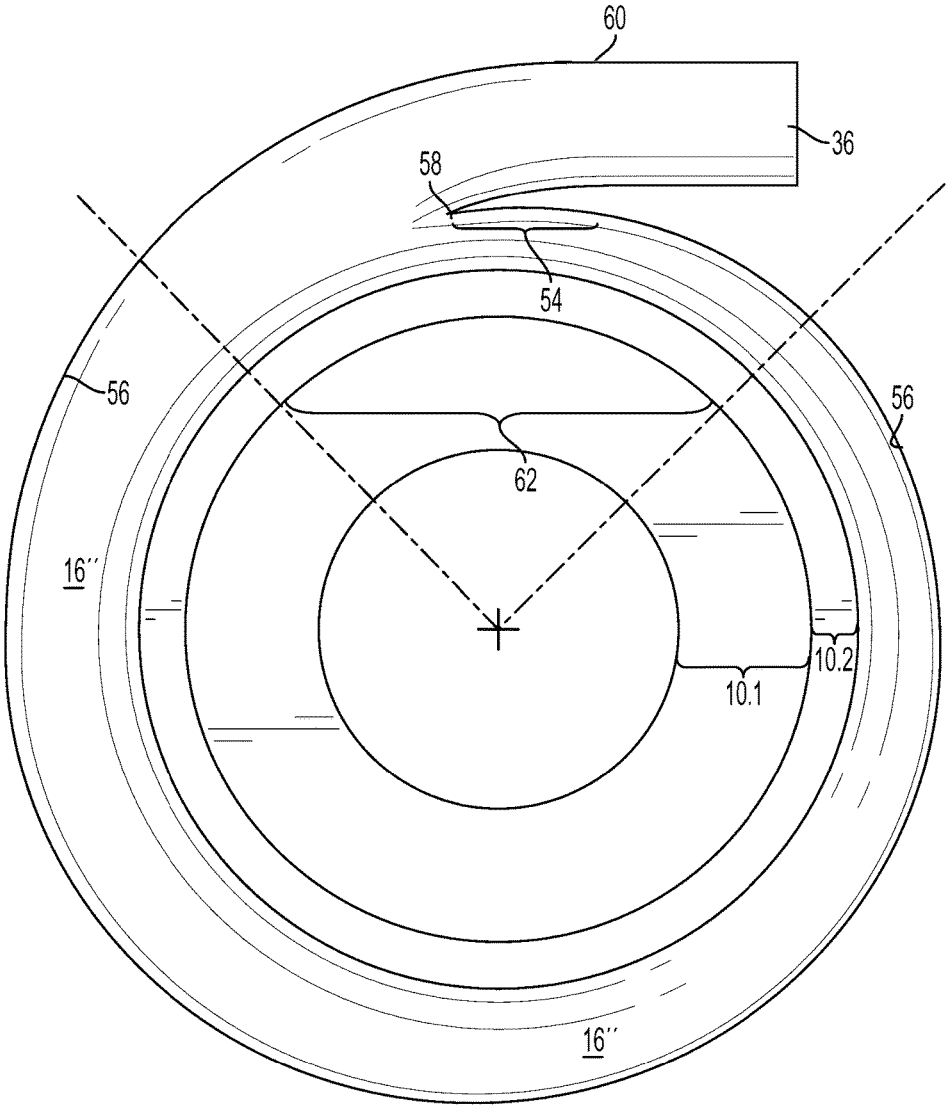
FIG. 9 illustrates a schematic transverse cross-section through the diffuser and associated volute, so as to illustrate the associated tongue of the volute and a region of proximity thereof to the associated vanes of the diffuser.

The orientation and slope of the leading-edge portions 48.1 of the vanes 48 are adapted to match the measured or analytically-or-computationally predicted exit flow conditions of the first annular portion 10.1, and, as described hereinabove, the orientation and slope of the trailing-edge portions 48.2 of the vanes 48 are adapted to match the entrance flow conditions of the collector 16. For example, in one set of embodiments, the trailing-edge portions 48.2 are configured so as to provide for a flow entrance angle 52 of 60 to 80 degrees—relative to the radial direction—with relatively low mean velocities in the range of 0.2 to 0.45 Mach number under substantially all operating conditions of the radial compressor 12. In one set of embodiments, each of the trailing-edge portions 48.2 is oriented at a uniform angle. Alternatively, referring to FIG. 9, either or both the angles of the trailing-edge portions 48.2, or the spacing, of vanes 48 proximate to the tongue 54 of the volute 16" could differ from the angle of the trailing-edge portions 48.2, or the spacing, of the remaining vanes 48. As illustrated in FIG. 9, the outermost-portion 56 of the volute 16" commences at the tip 58 of the tongue 54 and spirals outwardly until joining the outlet duct 36 at the outermost point 60 of the volute 16", wherein the tongue 54 is the portion of the boundary of the volute 16" between overlapping portions thereof. For example, in one set of embodiments, the angles of the trailing-edge portions 48.2, or the spacing, of the vanes 48 in a region 62 within +/−45 degrees of the tip 58 of the tongue 54 could differ from the angle of the trailing-edge portions 48.2, or the spacing, of the remaining vanes 48.

Figure 10:
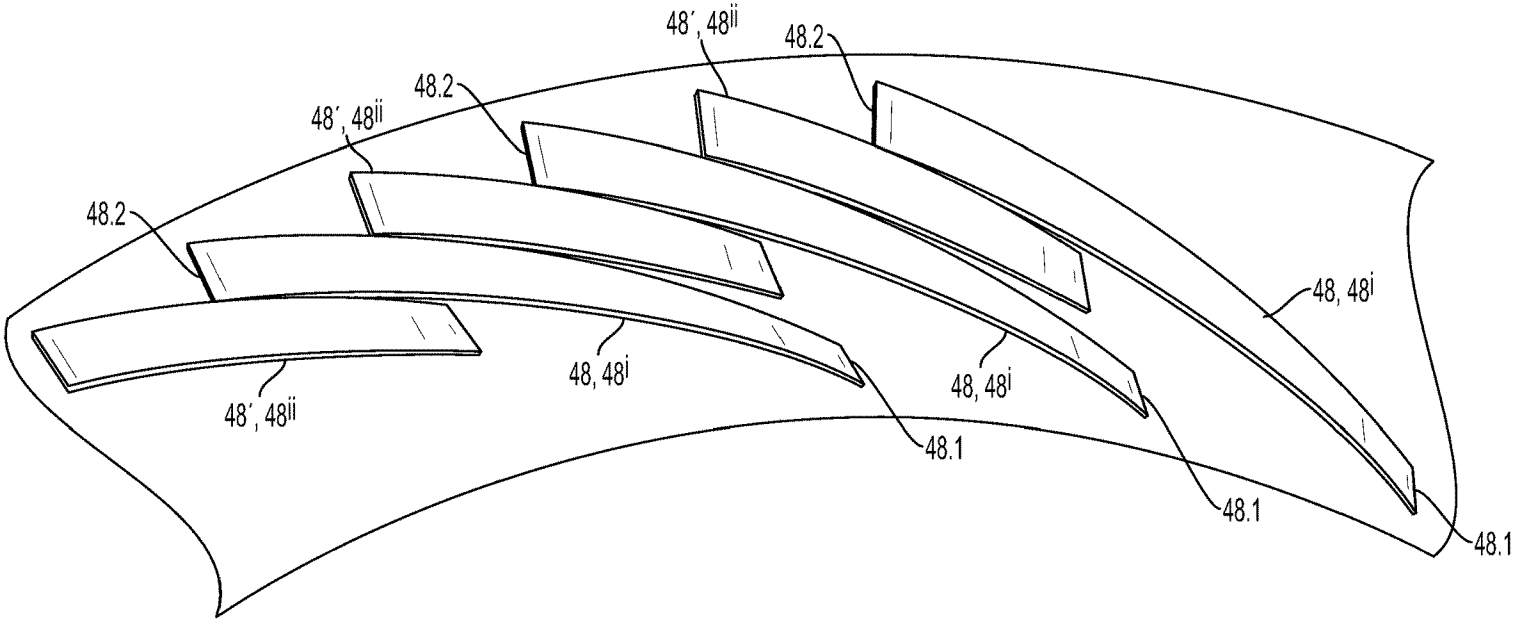
FIG. 10 illustrates a fragmentary portion of a plurality of vanes with splitter vanes interposed between full-length vanes.

Furthermore, referring to FIG. 10, each of the vanes 48 need not necessarily be of the same length. For example, some of the vanes 48—also known as splitter vanes 48'—could be of relatively shorter length, for example, the length of the vanes 48 could alternate, with one or more relatively shorter splitter vanes 48' located between each pair of full length vanes 48 for at least a portion of the ensemble of vanes 48. Accordingly, the plurality of vanes 48 comprises first $\mathbf{48}^{i}$ and second $\mathbf{48}^{ii}$ subsets of vanes 48, 48' interleaved with respect of one another, wherein each vane 48' of the second subset $\mathbf{48}^{ii}$ of vanes is relatively shorter than each vane 48 of the first subset $\mathbf{48}^{i}$ of vanes 48. The splitter vanes 48' may be oriented with twist similar to the adjacent full length vanes 48.

In accordance with a method of diffusing a flow of gases 18 from an impeller 14—provided for as described hereinabove,—the gases 18 are first directed from the impeller 14 into a first annular portion 10.1 of a diffuser 10, wherein the first annular portion 10.1 is bounded by forward 32 and aft 26 annular walls, the first annular portion 10.1 is vaneless, and the first annular portion 10.1 is of sufficient radial extent so that the flow of gases 18 from the impeller 14 is reduced in velocity from a relatively high velocity upon entrance to the first annular portion 10.1 to a mean velocity less than a Mach number threshold upon exiting the first annular portion 10.1, wherein the Mach number threshold is in the range of 0.7 to 0.4. Then, the gases 18 exiting the first annular portion 10.1 are directed into a second annular portion 10.2 of the diffuser 10, wherein the second annular portion 10.2 is bounded by the forward 32 and aft 26 annular walls, and the second annular portion 10.2 is concentric with, radial adjacent to, and around, a radially outer boundary 44 of the first annular portion 10.1. The gases 18 flowing through the second annular portion 10.2 are directed through a plurality of vanes 48 therewithin, wherein a contour of each vane 48 of the plurality of vanes 48 is shaped so as to substantially match a direction of the gas flow adjacent to the vane 48 for at least one operating condition during operation of the diffuser 10; and the gases 18 are also meridionally diverged while flowing through the second annular portion 10.2 of the diffuser 10. The gases flow from the second annular portion 10.2 of the diffuser 10 directly into a collector 16, for example, a plenum 16' or volute 16".

The combination of the vaneless first annular portion 10.1 with the twisted vanes 48 or relatively-high solidity within the meridionally-divergent second annular portion 10.2 provides for a relatively-compact diffuser 10, and provides for relatively-improving the efficiency of an associated volute 16".

In accordance with one embodiment, the radial compressor 12 incorporating the diffuser 10 is incorporated as the compressor of a turbocharger or supercharger (not illustrated), wherein the aft annular wall 26 of the radial compressor 12 is either operatively coupled to or a part of a centerbody 24 of the turbocharger or supercharger, wherein the centerbody 24 incorporates a plurality of bearings that support a rotor shaft that operatively couples the impeller 14 of the radial compressor 12 to a source of shaft power, for example, either an exhaust driven turbine of a turbocharger, a pulley or sprocket of an engine-driven supercharger, or an electric motor of a motor-driven supercharger.

It should be understood that the diffuser 10 is not limited to application either in combination with a radial compressor 12 as illustrated hereinabove, or to diffusing the flow of a gaseous medium. More particularly, it should be understood that the same type of diffuser 10 could also be utilized with either an axial-flow compressor with a significant non-axial—i.e. radial—exit flow region, or a mixed-flow compressor, i.e. wherein the gas flow exits the compressor in a direction other than purely radial or purely axial. Furthermore, it should be understood that the same type of diffuser 10 could also be utilized in cooperation with a pump rather than a compressor, for example, so as to provide for diffusing a flow of a liquid exiting the pump.

Figure 11B:
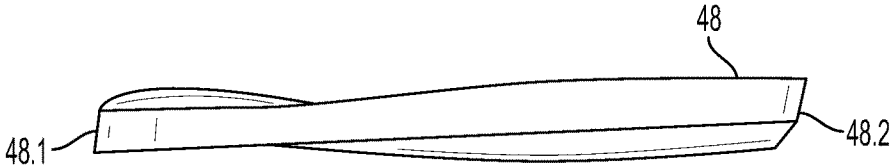
FIGS. 11*a-c* illustrate orthographic views of a typical vane of the diffuser, with FIG. 11*a* illustrating a plan view of the vane, FIG. 11*b* illustrating a side view of the vane.
Figure 11A:
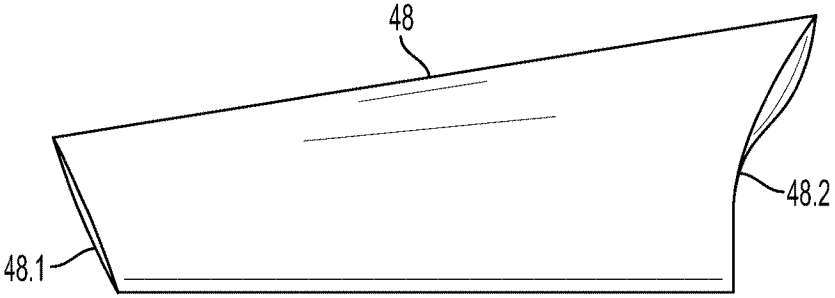
Figure 11C:
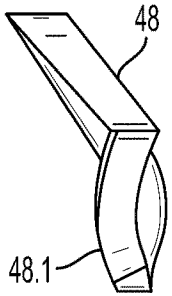

The vanes 48 of the diffuser 10 can be manufactured in a variety of ways, including, but not limited to, machining—for example, milling, Electrical Discharge Machining (EDM) or Electro Chemical Machining (ECM),—casting or additive manufacturing, either integral with the aft 26 or forward 32 annular walls of the diffuser 10, or formed individually in accordance with any of the above methods, or by stamping or forging, followed by insertion of or cooperation of the individually manufactured vanes 48 into or with slots or receptacles in the aft 26 or forward 32 annular walls of the diffuser 10. Referring to FIGS. 11*a-c*, each vane 48 is shaped—for example, twisted along the length, i.e. direction of flow, thereof—so as to substantially conform to the direction of the associated flow field within the second annular portion 10.2 when installed in the diffuser 10, during operation thereof.

While specific embodiments have been described in detail in the foregoing detailed description and illustrated in the accompanying drawings, those with ordinary skill in the art will appreciate that various modifications and alternatives to those details could be developed in light of the overall teachings of the disclosure. It should be understood, that any reference herein to the term "or" is intended to mean an "inclusive or" or what is also known as a "logical OR", wherein when used as a logic statement, the expression "A or B" is true if either A or B is true, or if both A and B are true, and when used as a list of elements, the expression "A, B or C" is intended to include all combinations of the elements recited in the expression, for example, any of the elements selected from the group consisting of A, B, C, (A, B), (A, C), (B, C), and (A, B, C); and so on if additional elements are listed. Furthermore, it should also be understood that the indefinite articles "a" or "an", and the corresponding associated definite articles "the" or "said", are each intended to mean one or more unless otherwise stated, implied, or physically impossible. Yet further, it should be understood that the expressions "at least one of A and B, etc.", "at least one of A or B, etc.", "selected from A and B, etc." and "selected from A or B, etc." are each intended to mean either any recited element individually or any combination of two or more elements, for example, any of the elements from the group consisting of "A", "B", and "A AND B together", etc. Yet further, it should be understood that the expressions "one of A and B, etc." and "one of A or B, etc." are each intended to mean any of the recited elements individually alone, for example, either A alone or B alone, etc., but not A AND B together. Furthermore, it should also be understood that unless indicated otherwise or unless physically impossible, that the above-described embodiments and aspects can be used in combination with one another and are not mutually exclusive. Accordingly, the particular arrangements disclosed are meant to be illustrative only and not limiting as to the scope of the invention, which is to be given the full breadth of the appended claims, and any and all equivalents thereof.

What is claimed is:

1. A turbomachine diffuser, incorporating:

a. a first annular wall incorporating a central opening configured to receive a fluid to be compressed or pumped;

b. a second annular wall;

c. a cavity between said first and second annular walls, wherein said cavity is shaped to receive an impeller that is in fluid communication with said central opening, said impeller provides for compressing or pumping said fluid into an annular portion of said cavity that is radially outboard of said impeller when said impeller is located in said cavity, said annular portion of said cavity comprises first and second annular portions, said first annular portion is concentric with, radially adjacent to, and downstream of a radially-outermost circumferential boundary of said impeller when said impeller is located within said cavity, said first annular portion is vaneless, said second annular portion is concentric with, radially adjacent to, and around a radially-outermost circumferential boundary of said first annular portion, said second annular portion is downstream of said first annular portion, an axial gap between said first and second annular walls increases with respect to radial distance within said second annular portion, wherein said radial distance is with respect to a central longitudinal axis of said impeller, and a ratio of a magnitude of said axial gap at a radially-outermost location of said second annular portion to a magnitude of said axial gap at a radially-innermost location of said second annular portion is at least 1.4 and at most 2.0;

d. a collector radially outboard of, and in fluid communication with, and downstream of, said second annular portion of said cavity, wherein said collector is in fluid communication with an outlet duct that provides for a discharge from said collector of said fluid compressed or pumped by said impeller within said cavity and thence into said collector; and e. a plurality of vanes incorporated in said second annular portion, wherein each vane of said plurality of vanes is twisted along a length thereof in a meridional direction, a ratio of a chord length of said vane to a mean circumferential separation distance between adjacent vanes of said plurality of vanes is at least 1.8 and at most 4.0, and a ratio of a maximum value of a radius of said second annular portion to a minimum value of said radius of said second annular portion is at least 1.08 and at most 1.20, wherein said radius of said second annular portion is with respect to said central longitudinal axis of said impeller.

2. A turbomachine diffuser as recited in claim 1, wherein a slope and orientation of a trailing-edge portion of said vane substantially matches the entrance flow conditions of said collector.

3. A turbomachine diffuser as recited in claim 1, wherein said collector is configured so as to substantially match the exit flow conditions of said plurality of vanes of said second annular portion.

4. A turbomachine diffuser as recited in claim 1, wherein for each said vane of said plurality of vanes and for at least one operating condition of said turbomachine diffuser, an orientation of a surface of said vane substantially conforms to a direction of a corresponding measured or computed flow field of said fluid within said second annular portion absent said plurality of vanes.

5. A turbomachine diffuser as recited in claim 1, wherein each said vane of said plurality of vanes is sufficiently twisted along said length thereof in said meridional direction within said second annular portion so that a leading edge of said vane substantially conforms to a corresponding measured or computed flow field of said fluid entering said second annular portion absent said plurality of vanes.

6. A turbomachine diffuser as recited in claim 1, wherein an angle of said trailing-edge portion of said vane relative to a radial direction is at least 60 degrees and at most 80 degrees.

7. A turbomachine diffuser as recited in claim 6, wherein said angle of said trailing-edge portion of said vane relative to said radial direction is substantially the same for each of said plurality of vanes.

8. A turbomachine diffuser as recited in claim 6, wherein said collector comprises a volute, and for a subset of said plurality of vanes proximate to a tongue of said volute, said angle of said trailing-edge portion of said vane relative to said radial direction, or at least one spacing between adjacent vanes of said subset of said plurality of vanes, is different from said angle or said spacing for a remainder of said plurality of vanes.

9. A turbomachine diffuser as recited in claim 1, wherein a ratio of a maximum value of a radius of said first annular portion to a minimum value of said radius of said first annular portion is such that during operation of said turbomachine diffuser under substantially all operating conditions a mean velocity of said fluid exiting said first annular portion does not exceed Mach 0.7, wherein the radii are with respect to said central longitudinal axis of said impeller.

10. A turbomachine diffuser as recited in claim 1, wherein said ratio of said chord length of said vane to said mean circumferential separation distance between said adjacent vanes of said plurality of vanes is at least 3.0 and at most 3.5.

11. A turbomachine diffuser as recited in claim 1, wherein an axial extent of each of said plurality of vanes substantially conforms to a corresponding portion of said axial gap of said second annular portion.

12. A turbomachine diffuser as recited in claim 1, wherein during operation of said turbomachine diffuser under substantially all operating conditions a mean velocity of said fluid exiting said second annular portion does not exceed Mach 0.5.

13. A turbomachine diffuser as recited in claim 1, wherein said collector comprises a volute.

14. A turbomachine diffuser as recited in claim 1, wherein said plurality of vanes comprises first and second subsets of vanes interleaved with respect of one another, wherein each vane of said second subset of vanes is relatively shorter than each vane of said first subset of vanes.

15. A turbomachine diffuser, comprising:

a. a first annular wall incorporating a central opening configured to receive a fluid to be compressed or pumped;

b. a second annular wall;

c. a cavity between said first and second annular walls, wherein said cavity is shaped to receive an impeller that is in fluid communication with said central opening, said impeller provides for compressing or pumping said fluid into an annular portion of said cavity that is radially outboard of said impeller when said impeller is located in said cavity, said annular portion of said cavity comprises first and second annular portions, said first annular portion is concentric with, radially adjacent to, and downstream of a radially-outermost circumferential boundary of said impeller when said impeller is located within said cavity, said first annular portion is vaneless, said second annular portion is concentric with, radially adjacent to, and around a radially-outermost circumferential boundary of said first annular portion, said second annular portion is downstream of said first annular portion, an axial gap between said first and second annular walls increases with respect to radial distance within said second annular portion, wherein said radial distance is with respect to a central longitudinal axis of said impeller, and a ratio of a maximum value of a radius of said second annular portion to a minimum value of said radius of said second annular portion is at least 1.08 and at most 1.20, wherein said radius of said second annular portion is with respect to said central longitudinal axis of said impeller;

d. a collector radially outboard of, and in fluid communication with, and downstream of, said second annular portion of said cavity, wherein said collector is in fluid communication with an outlet duct that provides for a discharge from said collector of said fluid compressed or pumped by said impeller within said cavity and thence into said collector; and e. a plurality of vanes incorporated in said second annular portion, wherein each vane of said plurality of vanes is twisted along a length thereof in a meridional direction, each said cane is sufficiently twisted along said length thereof in said meridional direction within said second annular portion so that a leading edge of said vane substantially conforms to a corresponding measured or computed flow field of said fluid entering said second annular portion absent said plurality of vanes, for each said vane and for at least one operating condition of said turbomachine diffuser, an orientation of a surface of said vane substantially conforms to a direction of a corresponding measured or computed flow field of said fluid within said second annular portion absent said plurality of vanes, and at least one of:

i. a slope and orientation of a trailing-edge portion of said vane substantially matches the entrance flow conditions of said collector; or ii. said collector is configured so as to substantially match the exit flow conditions of said plurality of vanes of said second annular portion.

16. A turbomachine diffuser as recited in claim 15, wherein an angle of said trailing-edge portion of said vane relative to a radial direction is at least 60 degrees and at most 80 degrees.

17. A turbomachine diffuser as recited in claim 16, wherein said angle of said trailing-edge portion of said vane relative to said radial direction is substantially the same for each of said plurality of vanes.

18. A turbomachine diffuser as recited in claim 16, wherein said collector comprises a volute, and for a subset of said plurality of vanes proximate to a tongue of said volute, said angle of said trailing-edge portion of said vane relative to said radial direction, or at least one spacing between adjacent vanes of said subset of said plurality of vanes, is different from said angle or said spacing for a remainder of said plurality of vanes.

19. A turbomachine diffuser as recited in claim 15, wherein a ratio of a maximum value of a radius of said first annular portion to a minimum value of said radius of said first annular portion is such that during operation of said turbomachine diffuser under substantially all operating conditions a mean velocity of said fluid exiting said first annular portion does not exceed Mach 0.7, wherein the radii are with respect to said central longitudinal axis of said impeller.

20. A turbomachine diffuser as recited in claim 15, wherein an axial extent of each of said plurality of vanes substantially conforms to a corresponding portion of said axial gap of said second annular portion.

21. A turbomachine diffuser as recited in claim 15, wherein during operation of said turbomachine diffuser under substantially all operating conditions a mean velocity of said fluid exiting said second annular portion does not exceed Mach 0.5.

22. A turbomachine diffuser as recited in claim 15, wherein said collector comprises a volute.

23. A turbomachine diffuser as recited in claim 15, wherein said plurality of vanes comprises first and second subsets of vanes interleaved with respect of one another, wherein each vane of said second subset of vanes is relatively shorter than each vane of said first subset of vanes.

24. A turbomachine diffuser as recited in claim 15, wherein a ratio of a chord length of said vane to a mean circumferential separation distance between adjacent vanes of said plurality of vanes is at least 1.8 and at most 4.0.

25. A turbomachine diffuser as recited in claim 24, wherein said ratio of said chord length of said vane to said mean circumferential separation distance between said adjacent vanes of said plurality of vanes is at least 3.0 and at most 3.5.

26. A turbomachine diffuser as recited in claim 15, wherein a ratio of a magnitude of said axial gap at a radially-outermost location of said second annular portion to a magnitude of said axial gap at a radially-innermost location of said second annular portion is at least 1.4 and at most 2.0.

* * * * *